US005180102A

United States Patent [19]

Gilbert et al.

[11] Patent Number: 5,180,102

[45] Date of Patent: Jan. 19, 1993

[54] TEMPERATURE CONTROL SYSTEM FOR ZONED SPACE

[75] Inventors: Jeffrey S. Gilbert, Cicero; Brett A. Desmarais, Clay, both of N.Y.

[73] Assignee: Carrier Corporation, Syracuse, N.Y.

[21] Appl. No.: 744,048

[22] Filed: Aug. 12, 1991

[51] Int. Cl.[5] ..... F24F 7/00

[52] U.S. Cl. ..... 236/49.3; 165/22

[58] Field of Search ..... 236/49.3, 51; 165/22

[56] References Cited

U.S. PATENT DOCUMENTS

| | | | |
|---|---|---|---|
| 4,732,318 | 3/1988 | Osheroff | 236/49 |
| 4,811,897 | 3/1989 | Kobayashi et al. | 236/51 X |
| 4,997,029 | 3/1991 | Otsuka et al. | 236/51 X |
| 4,997,030 | 3/1991 | Goto et al. | 236/51 X |

*Primary Examiner*—William E. Wayner

[57] ABSTRACT

A variable air volume control system has a temperature system management device which calculates an air flow setpoint in a temperature zone as a function of a proportional term that accommodates gross temperature-setpoint errors, and integral term that provides heating or cooling load matching, and a derivative term that accommodates rapid fluctuations in the cooling or heating load, and communicates the flow setpoint to a terminal control unit to adjust the air flow to a space. The terminal control unit will implement a flow setpoint as a function of the gross error in temperature in the space and a default temperature comfort setpoint upon failure of the temperature system management device to maintain a temperature in the zone.

3 Claims, 1 Drawing Sheet

TEMPERATURE CONTROL SYSTEM FOR ZONED SPACE

BACKGROUND OF THE INVENTION

This invention relates generally to control systems for controlling the temperature of multiple zoned space, such as a building, and more particularly to a variable air volume digital control system having a temperature system manager device which determines an air flow setpoint in a temperature zone as a percentage of the total air volume of a terminal in the temperature zone and as a function of the deviation of a local temperature sensor temperature from a setpoint schedule in the temperature system manager device, whereby the flow adjustments made by a local terminal control unit are at a higher rate than the rate of receipt by the terminal control unit of a flow target set by the temperature system manager device.

The utilization of variable air volume (VAV) air distribution systems to supply conditioned air from a central source thereof to offices, school rooms, and other similar spaces or areas in multi-room buildings has become increasingly more prevalent. Such VAV systems generally furnish varying volumes of air, at constant temperatures, into a space in accordance with the space or zone demands. The flow of conditioned air from outlets or terminals is generally regulated by operation of suitable damper means controlled by a thermostat sensing the temperature of the space being conditioned. Thus, as the temperature of the space deviates to a greater degree from a predetermined setpoint, the damper opens more as a direct result of the deviation and a greater quantity of conditioned air is discharged into the space. Conversely, when the temperature in the space being conditioned approaches the setpoint, the system decreases the air volume to the space depending upon the deviation of the space temperature from the setpoint. In U.S. Pat. No. 4,756,474 assigned to the same assignee as the present invention, there is described a pneumatic controller for a duct pressure powered air terminal unit having a volume controller which receives two pressure signals, whereby the controller bleeds one pressure signal so as to control the inflation of a bellows or bladder to thereby modulate the terminal unit to maintain a desired volume air flow through the unit, and bleeds the second pressure signal so as to maintain at least a minimum flow through the unit. The above-identified controller is an improvement over U.S. Pat. No. 4,120,453 which describes a three-way valve controller having two pressure regulators and a bleed type thermostat which provide four input signals to the three-way valve thereby providing a single pressure signal to the inflatable bellows.

In these prior systems, a target flow of air discharged to the space was based on a proportional-only term described as the difference between Temperature Setpoint and Actual Temperature multiplied by an empirically-derived constant of proportionality (k). This proportional-only term is used to modify, either up or down, the flow of air into the space as required, in order to maintain Temperature setpoint in the space. The empirically derived constant of proportionality (k) is fixed in value and thus supports only the fixed load characteristics as were exercised in empirically deriving the constant of proportionality (k) in the first place. These fixed load characteristics are typically the size of the heating or cooling load relative to heating or cooling capacity of the space, and the rate of change of the gross heating or cooling load. However, any variation in these factors in the actual building or space will result in a compromise in the control's ability to maintain the temperature setpoint.

Also in these prior systems the actual target flow is calculated by a centralized device, such as personal computer, electrically connected and communicating to several control devices for the damper means that regulate the flow of air into their corresponding spaces. A partial or catastrophic failure of this central computing device, or a partial or catastrophic failure of the electrical connection to the damper controller devices will result in a significant compromise in the temperature control in the space, since target flow updates are no longer possible. Thus single-point failures may result in complete loss of temperature control in a building.

Thus there is a clear need for a method and apparatus to determine, on a temperature zone basis, and in regard to actual and dynamic load conditions present, a flow (CFM) setpoint based on proportional, integral and derivative error terms and as a percent of air volume delivered by a terminal to the temperature zone on deviation of zone temperature from a scheduled setpoint signal, and then generate a higher rate of flow signals to be supplied to the air terminal to make multiple, and thus pressure independent, adjustments to the flow of air to the temperature zone for each flow setpoint signal generated.

Furthermore, a provision must be made for the terminal control unit or damper controller to recognize the absence of communication from the centralized computing device that typically calculates the flow setpoint and determine at that point in time that a failure of the system has occurred, at which time the local air terminal or damper controller will utilize a default temperature "comfort setpoint" and locally provide a proportional adjustment to air flow to the space based on error from temperature setpoint and actual temperature, and thus maintain reasonable comfort in the space until communication with the centralized computing device is re-established.

SUMMARY OF THE INVENTION

Accordingly, it is an object of the present invention to provide an improved air flow regulation within multiple temperature zones of a space.

It is another object of the present invention to provide a network communication between multiple temperature zones of a space and a terminal system manager which calculates a flow setpoint for each terminal control unit in a temperature zone.

It is still another object of the present invention to provide a means of accommodating a wide range of sizes in the heating or cooling load, as well as sudden changes in load, by means of introducing an Integral and Derivative, as well as a Proportional, error term in the calculation by which a flow setpoint is generated.

It is a further object of the present invention to provide a flow setpoint signal to a plurality of temperature zones and to make multiple adjustments to the air flow to the temperature zones for each periodic flow setpoint signal provided.

It is still a further object of the present invention to provide a regular and periodic communication between the terminal system manager and terminal control units in order that when a prolonged disruption of this period of communication occurs, the terminal control units shall themselves provide a temporary means of temperature control for the space until such time as periodic communication is restored.

These and other objects of the present invention are obtained by means of a control network for controlling the flow of air through the air terminals of a multiple temperature zoned space based on the calculation of a flow setpoint by a terminal system manager, on deviation of actual zone temperature from a desired zone temperature setpoint. A flow setpoint signal from the terminal system manager is provided to each terminal control unit for each air flow terminal of a temperature zone on a regular interval. Control of air flow to a temperature zone is obtained by adjusting the air flow through the air terminals of each temperature zone at an frequency greater than the regular interval of receipt by the terminal control unit of the flow setpoint provided by the terminal system manager, or upon absence or interruption of the flow setpoint from the terminal system manager the control of air flow is adjusted by the terminal control unit based on the error between temperature setpoint and actual space temperature.

BRIEF DESCRIPTION OF THE DRAWINGS

Other objects and advantages of the present invention will be apparent from the following detailed description in conjunction with the accompanying drawings forming a part of the specification in which reference numerals shown in the drawings designate like or corresponding parts throughout the same, and in which.

DESCRIPTION OF THE PREFERRED EMBODIMENT

Figure 1:
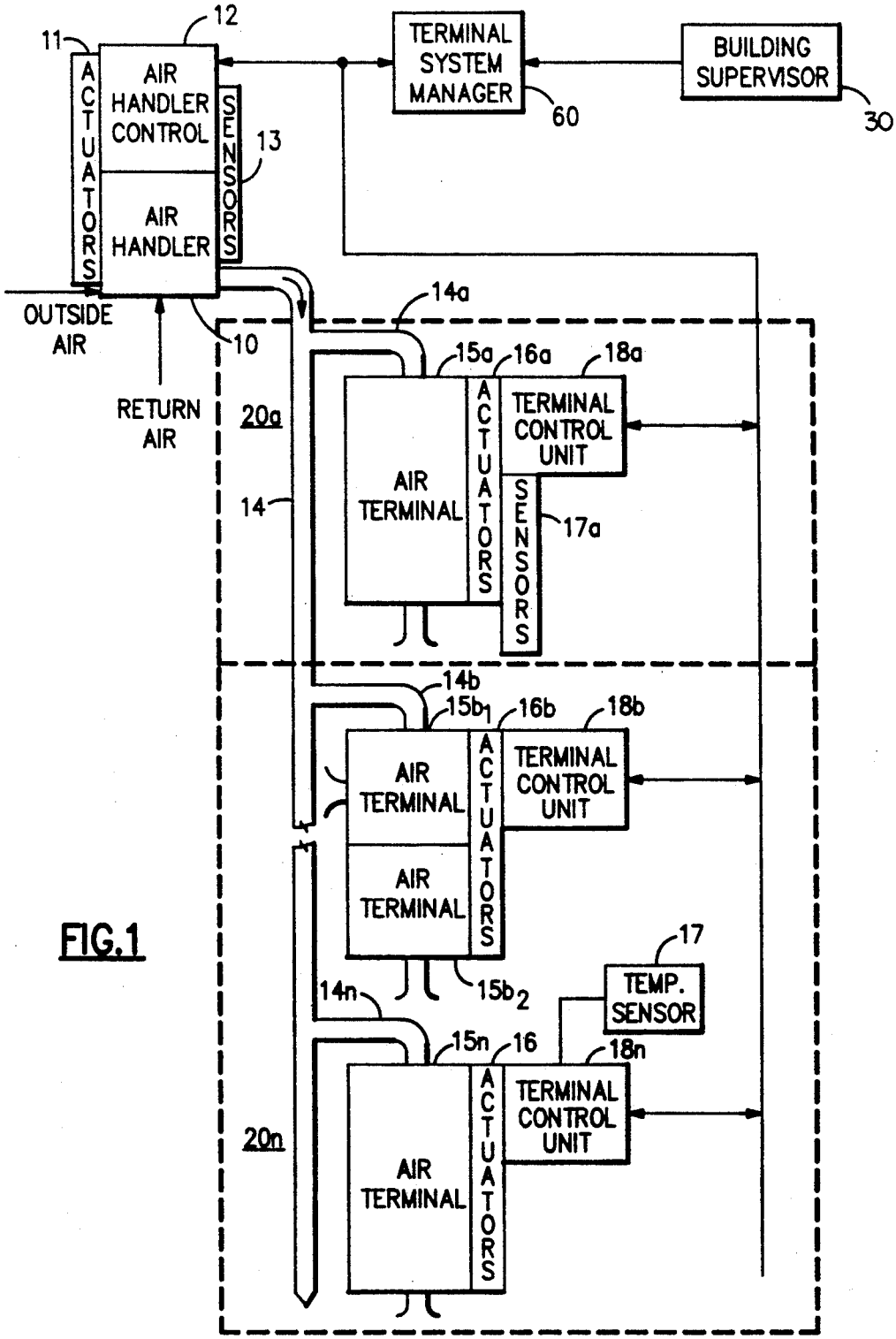
FIG. 1 is a diagrammatic representation of an air system that embodies the principles of the present invention.

In FIG. 1, the numeral 10 generally designates an air source, such as an air handler which includes a fan, cooling coil(s) and an electric or hot water heater. The air handler 10 receives return air and/or outside air which it delivers to duct 14. Actuators 11 control the outside and return air dampers for controlling the amounts of return and/or outside air. The air handler control 12 controls the air handler 10 by controlling the fan speed, coil(s) and heater and bypass around the fan, as is known. Sensors 13 detect the supply air temperature, as measured for example by a thermistor, and fan speed, as measured for example by the fan motor power. The conditioned air supplied to duct 14 is, in turn, supplied to branch lines 14-*n* which supply terminals 15*a-n*, respectively. Terminals 15*a-n* may be the inflatable bellows damper type in which plenum air is used to inflate, and thereby close, the bellows and to deflate, and thereby open, the bellows, or of the damper blade type in which an actuator opens and closes the damper blade, or similarly controlled terminals. Actuators 16*a-n* control the inflation of the bellows or movement of the damper blade or the like as is well known in the art. Sensors 17*a-n* respectively, sense the actual space temperature in each temperature zone 20*a-n* which is supplied to a single terminal control units 18*a-n* in each temperature zone, respectively. Terminal control units 18*a-n* contain the logic for controlling the actuators 16*a-n* based upon the space temperature data supplied by the single sensors 17*a-n* located in each temperature zone and the space temperature setpoint, which is adjusted remotely at the terminal system manager. The temperature zone 20*a-n* (as shown by the dashed lines), may include a single air terminal 15*a* controlled by terminal control unit 18*a*, or may include multiple air terminals 15*b*, (master terminal), 15$b_2$ (slave terminal) and 15*n* (master terminal), with each master terminal (15*b* and 15*n*) having a respective terminal control unit (18*b* and 18*n*), but each temperature zone having only one temperature sensor (17*a-n*) respectively. Space temperature control is maintained generally at the setpoint through the modulation of air flow through each air terminal. The terminal system manager 19, which may be located outside the space to be conditioned, contains occupancy schedules, set point schedules and receives, etc. and receives space temperature data from the terminal control unit. The building supervisor 30, which may also be located outside the conditioned space provides scheduling, control, and alarm functions for the air distribution system.

Figure 2:
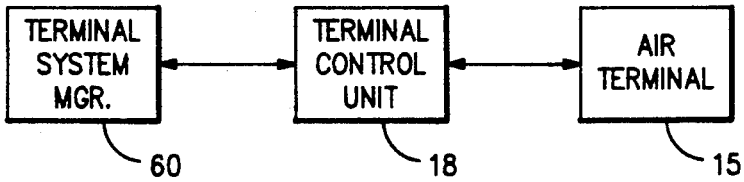
FIG. 2 is a block diagram of flow target setpoint based control of airflow terminals by terminal control units employing the present invention.

Referring now specifically to FIG. 2 for details of the adjustment of air terminal 15 by terminal control unit 18, terminal system manager 60 provides a control signal to the terminal control unit at a regular predetermined interval. The temperature setpoint logic and control is included in the terminal system manager 60. The terminal system manager calculates, on a temperature zone basis, an air terminal 15 flow setpoint, i.e. the cubic feet per minute air flow through an air terminal as a percent of the total design air flow of such air terminal, based on the deviation of the temperature of the temperature zone 20 from the temperature setpoint of such temperature zone.

The calculation of Flow Setpoint shall include a proportional term that accommodates gross temperature-setpoint errors, an integral term that provides heating or cooling load matching (air flow into the space provides a like amount of cooling for a heating load or heating for a cooling load), and a derivative term to accommodate rapid fluctuations in the cooling or heating load, as follows:

$$\text{Flow. SP (\% of total vol.)} = G_t \times (K_p \times P + K_i I + K_d \times D),$$

where:

P=Temperature Setpoint−Zone Space Temperature, (for heating), or Zone Space Temperature−Temperature Setpoint, (for cooling);

$K_p$=8, in 1/° F;

$$I = \Sigma I + (P \times R_1)$$
$$n = 0 \text{ to } \infty$$

where R is the periodic running rate of this process; and I is sum of all I terms from $I_0$ to $I_n$ $K_i$=0.06, in 1/° F. seconds;

If $I > 100(K_i \times G_t)$, then $I = 100/(K_i \times G_t)$, and

If $I > 0$, then $I = 0$;

D=(P−Previous P)/R, where R is the periodic running rate of this process;

$K_d$=1, in seconds/°F.; and $G_t$=Temperature Loop Gain Multiplier, defaulted to a value of 1. $G_t$ is adjustable by a user in a range from 0.1-10.

The Flow Setpoint will be clamped between the values of 0 and 100 when the calculation results in values outside this range.

The temperature control unit, upon receipt of the calculated flow setpoint signal sends a flow adjustment signal to the terminal at intervals which are less than the predetermined intervals between setpoint output signals, thus modifying the terminal flow at a rate higher than the received rate of the setpoint signals from the terminal system manager. For example, assume the terminal system manager generates a setpoint target once per minute, which is supplied to the terminal control unit, then the terminal control unit will generate a flow adjustment signal to the air terminal to adjust the air terminal every 5 seconds. Thus, the air terminal will be adjusted twelve times per each setpoint adjustment. The higher frequency of adjustment to the air terminal in relation to the frequency of the output setpoint signal generated by the terminal system manager provides an improved degree of control for each temperature zone, and is independent of fluctuations in system duct pressure.

Now referring to FIG. 2 once again, communication from the terminal system manager (60) to the terminal control unit (18) will occur periodically in order that the terminal system manager may obtain space temperature from the terminal control unit and also that the terminal system manager may send a flow setpoint to a terminal control unit. This communication is always initiated by the terminal system manager, either with a temperature request or a flow setpoint.

This periodic communication will occur, for example, every 30 seconds. Thus the terminal control unit can expect to hear from the terminal system manager every 30 seconds. Should an unusually long period of time occur where no communication has been received by the terminal control unit from the terminal system manager, for example 10 minutes, the terminal control unit will assume that the terminal system manager, through some physical failure in the terminal system manager itself or the communication wire between them , is unable to provide flow setpoints. Thus the terminal control unit, which has limited processing resources, will itself implement a flow setpoint calculation based strictly on the gross error in temperature in the space versus a default temperature comfort setpoint in the order of 55° F.-95° F., for example 72° F., as follows:

$$\text{Default Flow Setpoint (\% of total volume)} = K_p \times P,$$

where

P=desired temperature−Zone Space Temperature (for heating), or Zone Space Temperature−-desired temperature (for cooling), and $K_p$=8, in 1/° F.

This will provide, until communication with the terminal system manager is re-established, a temporary means of temperature control, thus maintaining comfort in the space. Once communication with the terminal system manager is re-established, the terminal control unit will end its local calculation of Flow Setpoint and once again use the information received from the terminal system manager.

While the invention has been described in detail with reference to the illustrative embodiments, many modifications and variations would present themselves to those skilled in the art.

We claim:

1. A temperature control system for controlling the flow of air into a plurality of temperature zones of a building, each temperature zone having at least one air terminal to adjustably maintain a variable volume of air into the associated temperature zone, comprising:

a system management means generating a desired air flow setpoint schedule for the plurality of temperature zones, and a terminal control means for each temperature zone for receiving the generating desired air flow setpoint for varying the air through an associated air terminal to the desired air flow setpoint;

wherein said desired air flow setpoint is calculated using the following formula:

$$\text{Flow Setpoint} = G_t \times (K_p \times P + K_i \times I + K_d \times D)$$

where:

P=Temperature Setpoint−Zone Space Temperature, (for heating), or Zone Space Temeprature−Temperature Setpoint, (for cooling);

$$I = \Sigma I + (P \times R_1)$$
$$n = 0 \text{ to } \infty$$

where R is the periodic running rate of this process; and I is sum of all I terms from $I_o$ to $In_n$ $K_i$=0.06, in 1/° F. seconds;

If I >100 ($K_i \times G_t$), then I=100/($K_i \times G_t$), and

If I <0, then I=O;

D=(P−Previous P)/R, where R is the periodic running rate of this process;

$K_d$=1, in seconds/°F.; and $G_t$=Temperature loop Gain Multiplier, having a range from 0.1-10.

2. A temperature control system as setforth in claim 1 wherein if said terminal control means fails to receive said generated air flow setpoint after a predetermined period then said terminal control means will generate a default flow setpoint to vary the air through an associated air terminal to the default flow setpoint.

3. A temperature control system as setforth in claim 2 wherein said default flow setpoint is calculated using the following formula:

$$\text{Default setpoint} = K_p \times P,$$

where

P=desired temperature−Zone Space Temperature (for heating), or Zone Space Temperature−-desired temperature (for cooling), and $K_p$=8, in 1/° F.

* * * * *